US011559722B2

(12) United States Patent
Lewis, Jr.

(10) Patent No.: US 11,559,722 B2
(45) Date of Patent: Jan. 24, 2023

(54) HAND GRIP EXERCISE APPARATUS AND METHODS OF USING SAME

(71) Applicant: Leo Nelson Lewis, Jr., Leesville, SC (US)

(72) Inventor: Leo Nelson Lewis, Jr., Leesville, SC (US)

( * ) Notice: Subject to any disclaimer, the term of this patent is extended or adjusted under 35 U.S.C. 154(b) by 80 days.

(21) Appl. No.: 17/142,352

(22) Filed: Jan. 6, 2021

(65) Prior Publication Data

US 2021/0205657 A1 Jul. 8, 2021

(51) Int. Cl.

| | |
|---|---|
| ***A63B 23/16*** | (2006.01) |
| ***A63B 23/035*** | (2006.01) |
| ***A63B 21/00*** | (2006.01) |
| ***A63B 21/072*** | (2006.01) |

(52) U.S. Cl.

CPC ..... *A63B 23/16* (2013.01); *A63B 21/0726* (2013.01); *A63B 21/4035* (2015.10); *A63B 23/03508* (2013.01)

(58) Field of Classification Search

CPC . A63B 23/16; A63B 21/0726; A63B 21/4035; A63B 23/03508

See application file for complete search history.

(56) References Cited

U.S. PATENT DOCUMENTS

| | | | | |
|---|---|---|---|---|
| 4,681,315 | A * | 7/1987 | Yang | A63B 21/0726 482/50 |
| 4,743,017 | A * | 5/1988 | Jaeger | A63B 21/0728 482/108 |
| 4,905,988 | A * | 3/1990 | Mooneyhan | A63B 59/20 482/121 |
| 5,651,758 | A * | 7/1997 | Cervantes | A63B 21/078 482/93 |
| 6,183,400 | B1 * | 2/2001 | Pope | A63B 21/4019 74/551.8 |
| 8,267,841 | B1 * | 9/2012 | Allison | A63B 21/075 482/106 |
| 9,149,680 | B2 * | 10/2015 | Thompson | A63B 21/072 |
| 9,192,808 | B2 * | 11/2015 | Stone | A63B 21/068 |
| 9,636,833 | B1 * | 5/2017 | Brucker | A21C 15/00 |
| 9,731,159 | B2 * | 8/2017 | Reynolds | A63B 21/4035 |
| 10,004,970 | B1 * | 6/2018 | Mailander | A63B 71/0054 |
| D845,407 | S * | 4/2019 | Sorin | A21C 15/00 D21/694 |
| 10,610,721 | B2 * | 4/2020 | McCall | A63B 21/0722 |
| 11,179,588 | B2 * | 11/2021 | McCall | A63B 1/00 |
| 2003/0089832 | A1 * | 5/2003 | Gold | G06F 1/1632 248/454 |
| 2008/0156199 | A1 * | 7/2008 | Ekberg | A47J 37/0786 99/380 |
| 2012/0184415 | A1 | 7/2012 | Rothacker | |
| 2013/0012360 | A1 * | 1/2013 | Stone | A63B 21/4043 482/23 |
| 2014/0135186 | A1 | 5/2014 | Reynolds et al. | |
| 2016/0263733 | A1 | 9/2016 | Marquis | |
| 2018/0140890 | A1 | 5/2018 | Sheppard et al. | |

* cited by examiner

*Primary Examiner* — Andrew S Lo

(74) *Attorney, Agent, or Firm* — Todd A. Serbin; Nexsen Pruet, LLC

(57) ABSTRACT

A hand grip exercise apparatus, comprising: a first half configured with at least one vertical surface, at least one horizontal surface and at least one angled portion; a second half configured with at least one vertical surface, at least one horizontal surface and at least one angled portion; and, a hinge, connecting the first half to the second half at the angled portions of each half.

17 Claims, 7 Drawing Sheets

HAND GRIP EXERCISE APPARATUS AND METHODS OF USING SAME

RELATED APPLICATION

This application claims the benefit of priority under 35 U.S.C. § 119(e) of U.S. Provisional Patent Application No. 62/957,503 filed Jan. 6, 2020, the contents of which are incorporated herein by reference in their entirety.

FIELD OF THE INVENTION

The present invention, in some embodiments thereof, relates to exercise and fitness and, more particularly, but not exclusively, to a device and methods for achieving exercise and fitness.

BACKGROUND OF THE INVENTION

The objective of improving grip strength and equipment for performing this improvement have existed for decades, if not longer. Typically, grip strength equipment has consisted of squeeze grip hand exercises which consist of two handles connected together by a metal coil which is elastically deformable when the handles are squeezed together by the user. Grip strength is theoretically improved by repetitive squeezing of the handles towards each other, the resistance to the motion being provided by the elastically deformable metal coil. An example of such a device, "Squeeze Grip Hand Exercisers", can be found at www.exercise-equipment-parts.com/squeeze-grip-exercisers.html.

SUMMARY OF THE INVENTION

According to an aspect of some embodiments of the present invention there is provided a hand grip exercise apparatus, comprising: a first half configured with at least one vertical surface, at least one horizontal surface and at least one angled portion; a second half configured with at least one vertical surface, at least one horizontal surface and at least one angled portion; and, a hinge, connecting the first half to the second half at the angled portions of each half.

In an embodiment of the invention, the first half and the second half are generally L-shaped with added angled portions, where the angled portions terminate at the hinge.

In an embodiment of the invention, for each L-shaped half the at least one horizontal surface forms the bottom of the L-shape and the at least one vertical surface forms the vertical of the L-shape.

In an embodiment of the invention, a junction where the vertical surface and the horizontal surface meet is curved.

In an embodiment of the invention, the first half and second half are connected together at the hinge as mirror images, such that the angled portions angle towards each other.

In an embodiment of the invention, the horizontal surfaces of the first L-shaped half and second L-shaped half face towards each other.

In an embodiment of the invention, the hinge is biased.

In an embodiment of the invention, the hinge is spring-loaded.

In an embodiment of the invention, the apparatus further comprises at least one mounting hole.

In an embodiment of the invention, the apparatus further comprises at least one tongue for spacing the first half from the second half.

In an embodiment of the invention, the apparatus further comprises texturing on at least one vertical surface of the apparatus for enhancing gripping of the apparatus.

According to an aspect of some embodiments of the present invention there is further provided a hand grip exercise apparatus, comprising: a first half configured with at least two vertical surfaces and at least two angled portions; a second half configured with at least two vertical surfaces and at least two angled portions; and, a hinge, connecting the first half to the second half at one of the angled portions of each half, wherein an upper portion of the hand grip exercise apparatus comprises a vertical surface and an angled portion of the first half and a vertical surface and angled portion of the second half.

In an embodiment of the invention, the apparatus further comprises a tongue disposed on the angled portion of the first half of the upper portion and on the angled portion of the second half of the upper portion.

In an embodiment of the invention, the length of at least one tongue is adjustable.

In an embodiment of the invention, the hinge is biased.

In an embodiment of the invention, the hinge is spring-loaded.

In an embodiment of the invention, the apparatus further comprises at least one mounting hole.

In an embodiment of the invention, the apparatus further comprises texturing on at least one vertical surface of the apparatus for enhancing gripping of the apparatus.

According to an aspect of some embodiments of the present invention there is further provided a method of using a hand grip exercise apparatus, comprising: opening at least one of a first half or a second half of the apparatus to place the apparatus in an at least partially open configuration; inserting a weight within the apparatus and/or suspending a weight from the apparatus; transitioning the apparatus to a closed configuration; and, exercising using the apparatus.

In an embodiment of the invention, the method further comprises, or in the alternative of opening/inserting/transitioning, suspending the weight from the apparatus.

In an embodiment of the invention, the method further comprises repeating the exercising until at least one exercise objective is met.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings. With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

DESCRIPTION OF SPECIFIC EMBODIMENTS OF THE INVENTION

Figure 1:
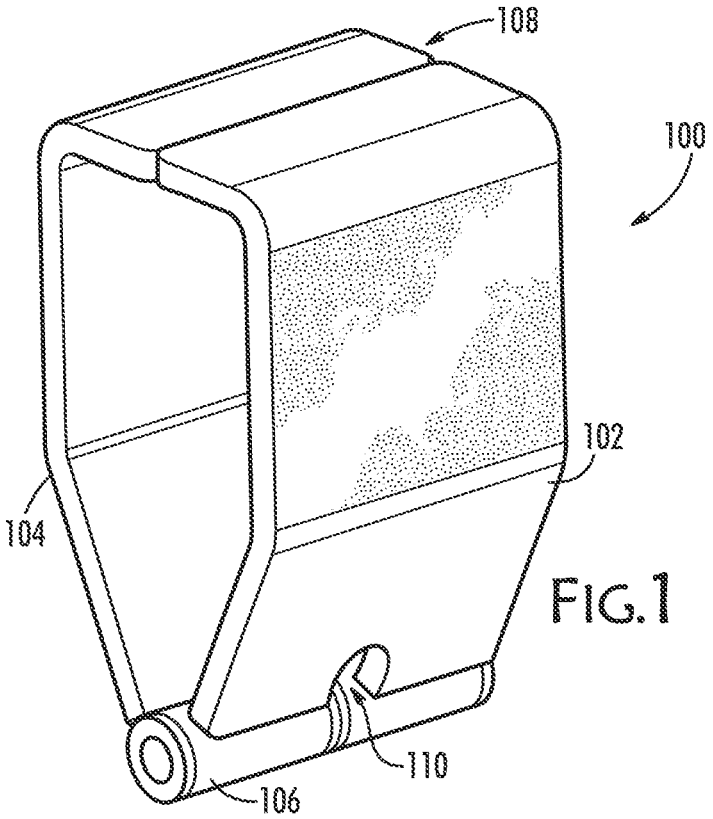
FIG. 1 is a perspective view of a hand grip exercise apparatus, in accordance with an exemplary embodiment of the invention.

The present invention, in some embodiments thereof, relates to exercise and fitness and, more particularly, but not exclusively, to a device and methods for achieving exercise and fitness.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 2:
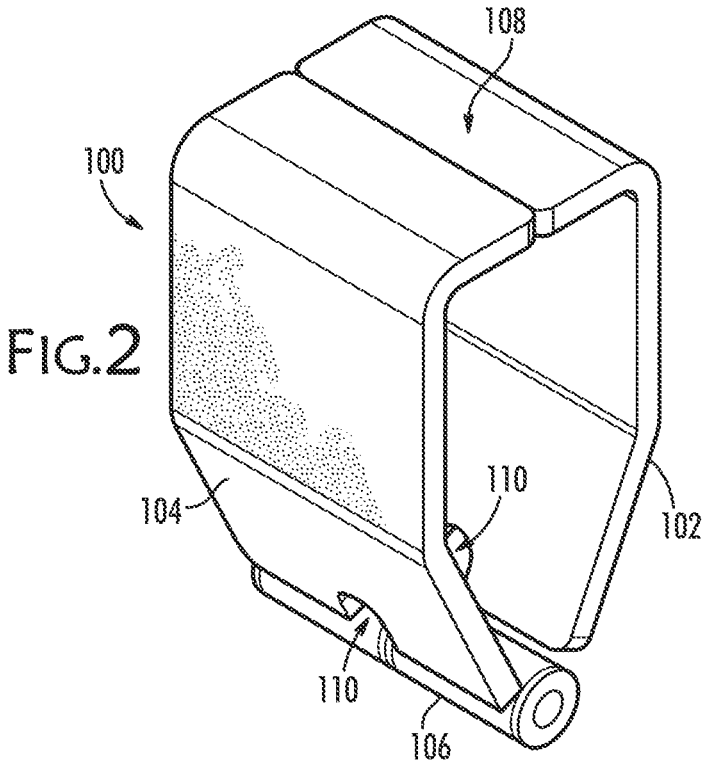
FIG. 2 is a rotated perspective view of the hand grip exercise apparatus of FIG. 1, in accordance with an exemplary embodiment of the invention.
Figure 3:
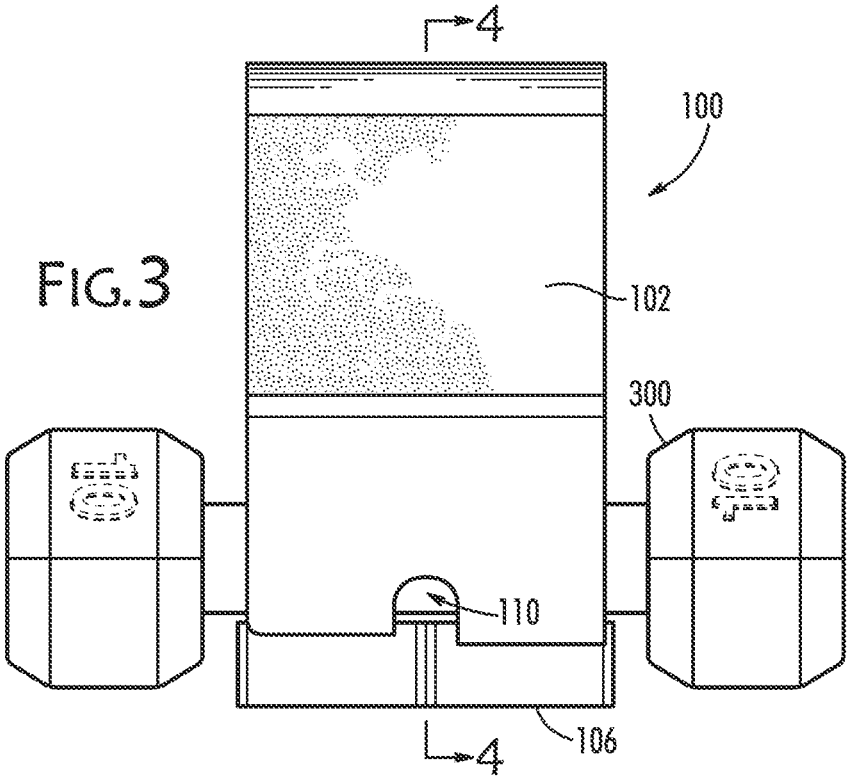
FIG. 3 is a front/back view of the hand grip exercise apparatus of FIG. 1, in accordance with an exemplary embodiment of the invention.
Figure 4:
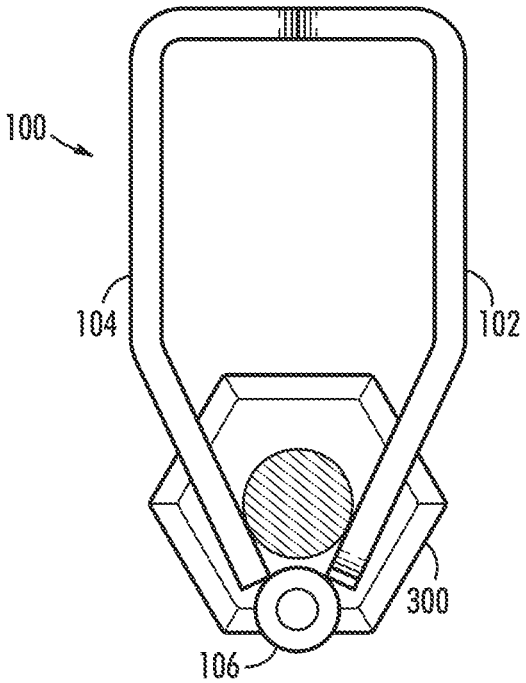
FIG. 4 is a right/left, cross-sectional side view of the hand grip exercise apparatus of FIG. 1, in accordance with an exemplary embodiment of the invention.
Figure 7:
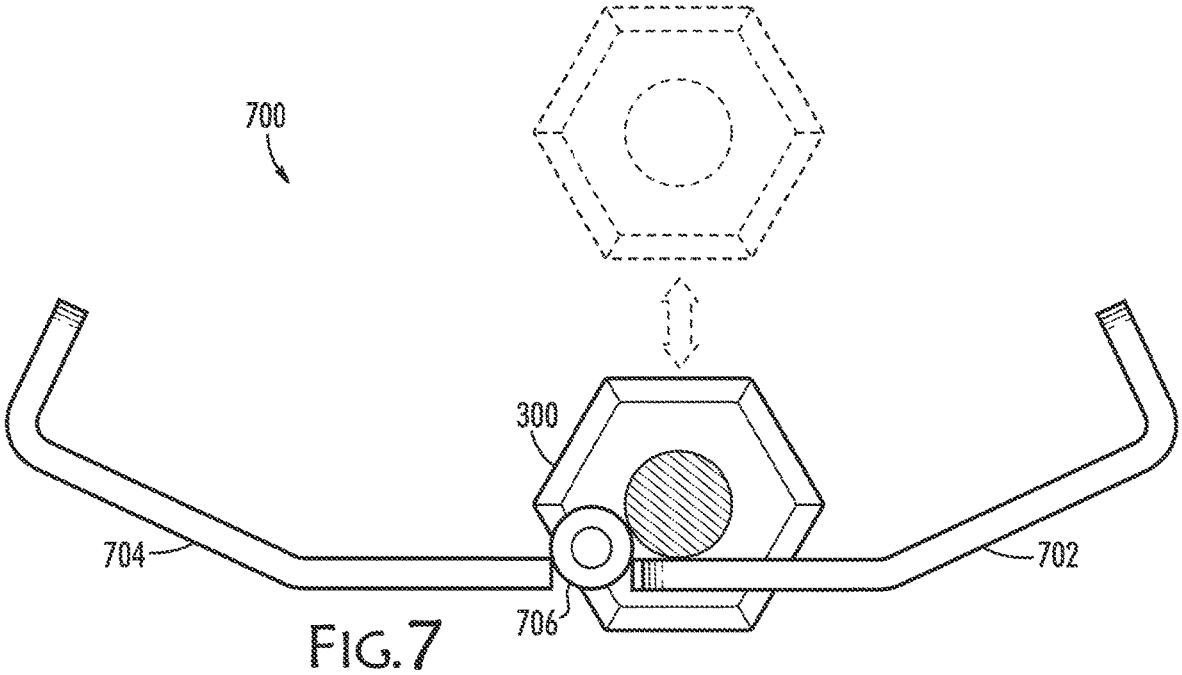
FIG. 7 is a schematic view of a step of using a hand grip exercise apparatus, in accordance with an exemplary embodiment of the invention.
Figure 8:
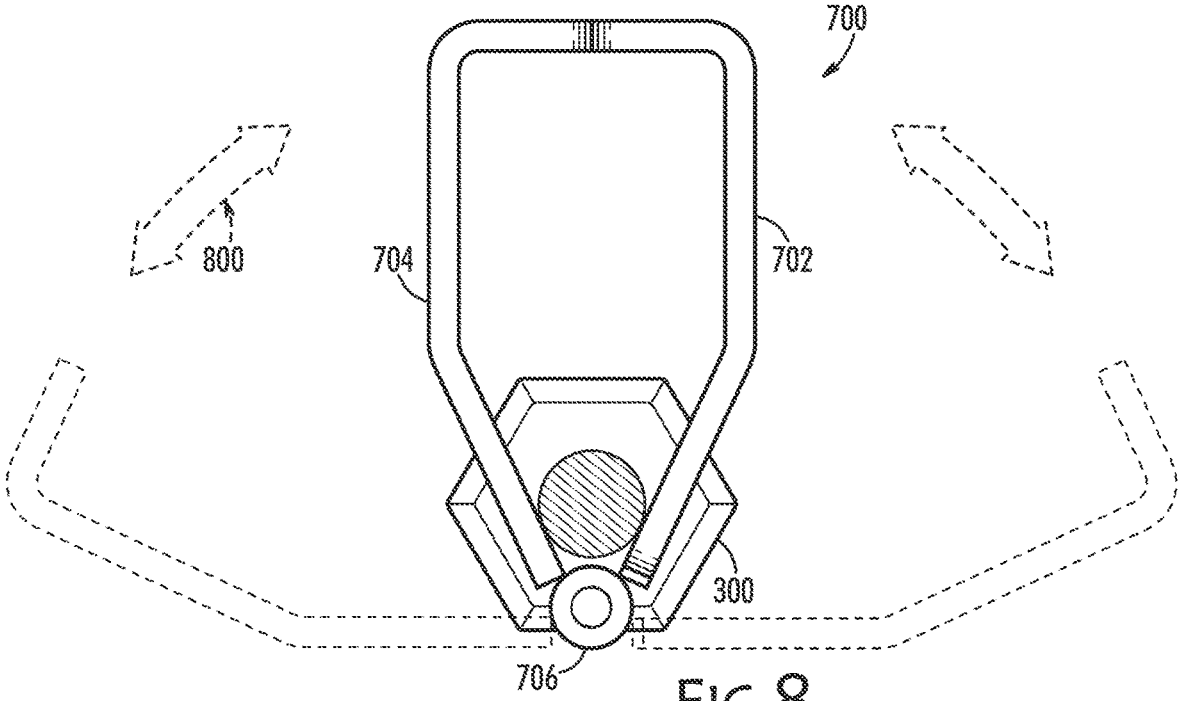
FIG. 8 is a schematic view of a second step of using the hand grip exercise apparatus of FIG. 1, in accordance with an exemplary embodiment of the invention.

Referring now to the drawings, FIG. 1 is a perspective view of a hand grip exercise apparatus 100, in accordance with an exemplary embodiment of the invention. In some embodiments of the invention, the apparatus 100 is generally of a "clam-shell" design, with two mirror-image, or near mirror-image, halves 102, 104 which are connected together by a hinge 106 or other similar connective device capable of enabling the rotation of at least one of the halves 102, 104 with respect to each other to "open" the apparatus 100 (such as shown in FIGS. 7 and 8). Opposite the hinge 106, the two halves 102, 104 optionally abut one another when the apparatus 100 is in the closed configuration shown in FIGS. 1 and 2, for example for space-efficient storage or during actual use for exercise (such as shown in FIGS. 3, 4, 8, and 9). In an embodiment of the invention, the first half 102 and the second half 104 are generally L-shaped (upside-down, as shown in FIG. 1) with added angled portions, where the angled portions of each half 102, 104 converge towards each other and terminate at the hinge 106. In some embodiments of the invention, the angled configuration of the halves 102, 104, as they angle towards each other, facilitates stable positioning of a weight 300 within the space between the halves, for example as the handle of the bar bell is shown in FIGS. 3 and 4.

In an embodiment of the invention, where the apparatus 100 is gripped from the side opposite the hinge 106 (such as shown in FIG. 7), the width of the halves 102, 104 (defined by a horizontal surface of the L-shape as shown in FIG. 4, extending horizontally at the top of the Figure and extending towards a central, vertical axis of the apparatus) is sized to increase the distance between the user's fingers and thumb, which in turn alters the level of difficulty of the gripping exercise. In some embodiments of the invention, the width is permanently set by the size of the horizontal surface of at least one of the L-shaped halves. Optionally, this width is adjustable, for example by having an extendible horizontal surface or by having attachments to make it longer. In an embodiment of the invention, the parallel sides of the halves 102, 104 are where the fingers and thumb, respectively, are located during exercise.

In an embodiment of the invention, where the apparatus 100 is gripped from the hinge 106 side (the direction opposite shown in FIG. 7), the shape of the halves 102, 104 is designed to be ergonomically adapted to gripping by a single hand of a user, for example, where the hinge is approximately positioned near where the user's hand bends where the fingers meet the palm and/or the angled portions parallel the generally triangular shape formed by a partially closed hand with the fingers extended and/or where the flat portions forming the vertical surface (as shown in FIG. 4, inter alia) of the L-shape are positioned approximately to where the finger tips and/or thumb are located in a partially closed hand with the fingers extended.

In some embodiments of the invention, the hinge 106 biases the apparatus 100 into an "open" or "closed" configuration. For example, the hinge 106 could be spring-loaded. In some embodiments, a locking mechanism (not shown) can be used to attach the halves 102, 104 to one another on the opposite side 108 where the halves abut one another. FIG. 2 is a rotated 90°, perspective view of the hand grip exercise apparatus 100 of FIG. 1, in accordance with an exemplary embodiment of the invention. In some embodiments of the invention, the apparatus 100 is provided with at least one mounting hole 110, through which an additional component may be attached. At least one clip, band, latch, hook, carabiner, hoop, and/or rod, are examples of an additional component which could be attached to and/or passed through the hole 110, for example to attach something to the apparatus 100, such as a weight and/or weighty item. Optionally, there are a plurality of mounting holes 110.

Figure 9:
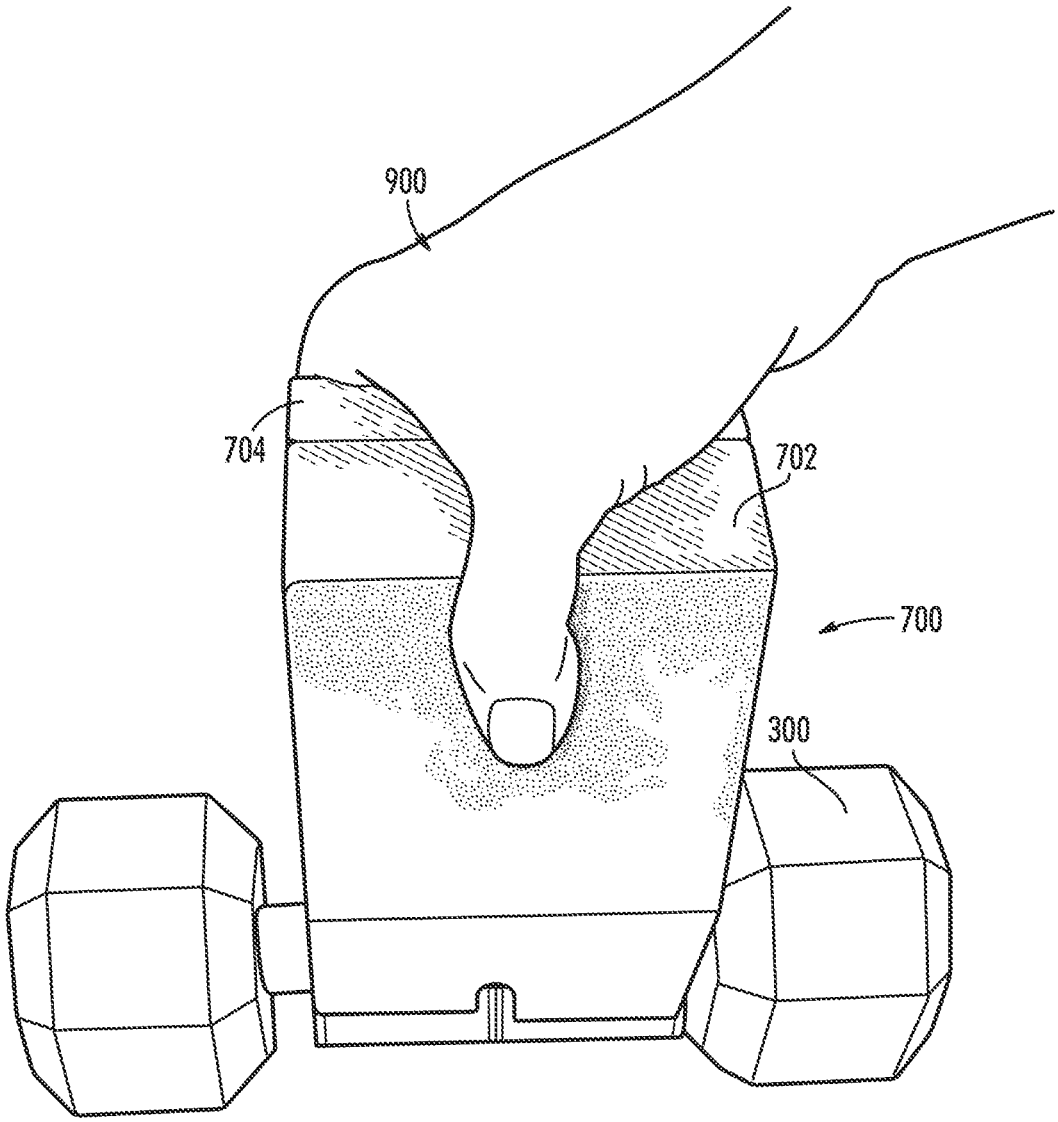
FIG. 9 is a perspective view of a hand grip apparatus in use, in accordance with an exemplary embodiment of the invention.

FIG. 3 is a front/back view of the hand grip exercise apparatus 100 of FIG. 1, in accordance with an exemplary embodiment of the invention. Also shown in FIG. 3 is a weight 300 which is disposed within the apparatus 100, shown in more detail with respect to FIG. 4, in order to provide weighted resistance to exercises using the apparatus 100 (such as shown in FIG. 9). Weight 300, in an embodiment of the invention, is a dumbbell. As shown in FIG. 4, the junction where the vertical surface meets the horizontal surface is curved or rounded, in some embodiments of the invention, to enhance the comfort of a user gripping the apparatus 100.

Figure 5:
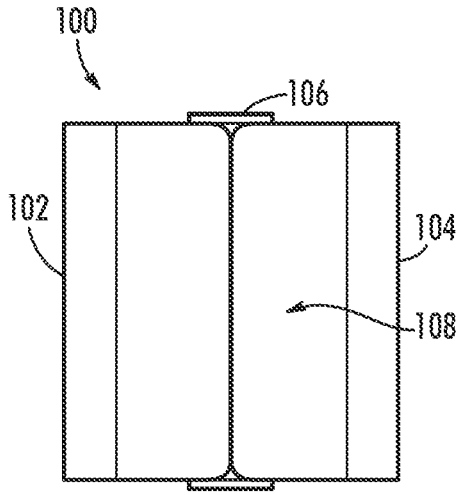
FIG. 5 is a top view of the hand grip exercise apparatus of FIG. 1, in accordance with an exemplary embodiment of the invention.
Figure 6:
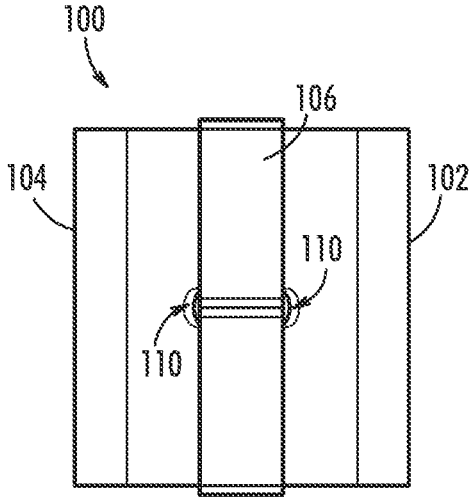
FIG. 6 is a bottom view of a hand grip exercise apparatus, in accordance with an exemplary embodiment of the invention.

FIG. 5 is a top view of the hand grip exercise apparatus 100 and FIG. 6 is a bottom view of the hand grip exercise apparatus 100 of FIG. 1, in accordance with an exemplary embodiment of the invention.

FIG. 7 is a schematic view of a step of using a hand grip exercise apparatus 700, in accordance with an exemplary embodiment of the invention. In interests of efficiency, FIGS. 7-9 are described in conjunction with FIG. 12, which is a flowchart 1200 of a method of using a hand grip exercise apparatus, in accordance with an exemplary embodiment of the invention. It should be noted that while the hand grip exercise apparatus 100 of FIG. 1 is shown in FIGS. 7-9, any hand grip exercise apparatus embodiment 700 (for example, those also shown and described with respect to FIGS. 10 and 11) could be used as shown in FIGS. 7-9 and 12.

Although apparatus 700 is shown fully opened (1202) in FIG. 7, it should be understood that the apparatus 700 only needs to be opened sufficiently to allow for the insertion (1204) of the weight 300 therein (in embodiments where a weight 300 is being used). A weight 300 is shown inserted (1204) into the hand grip exercise apparatus 700 while the apparatus 700 is in an at least partially open configuration. FIG. 8 shows the movement 800 of at least one of the halves 702, 704 of the apparatus 700 to transition (1206) the apparatus 700 from an at least partially open configuration to a closed configuration. In an embodiment of the invention, when the apparatus 700 is closed the weight 300 is centered within the apparatus 700, such as shown in FIG. 8.

As described above, in some embodiments of the invention, alternatively and/or additionally and/or optionally a weight is suspended (1208) and/or attached to the apparatus 700 by using an additional component through the mounting hole 110. So in some operative examples, the user 900 does not need to perform any actions (1202)-(1206), and instead commences use by suspending (1208) a weight from the apparatus in order to exercise (1210). As can be appreciated by the disclosure, a weight could be inserted (1204) into the apparatus and a weight could be simultaneously suspended (1208) from the apparatus for exercising (1210).

FIG. 9 is a perspective view of the hand grip exercise apparatus 700 in use, in accordance with an exemplary embodiment of the invention. In some embodiments of the invention, a user 900 grips the apparatus 700 by squeezing the halves 702, 704 while the weight 300 is trapped within the apparatus 700 (and/or suspended from the apparatus) and then exercises (1210), for example by repeated raising, twisting, rotating, and/or lowering the apparatus 700. Optionally, the exercise (1210) movement (and/or additional exercise movements) is repeated (1212) depending on the exercise objectives of the user 900. In some embodiments of the invention, at least one of the sides and/or other surfaces of the apparatus 700 are texturized to enhance gripping by the user 900.

Figure 10:
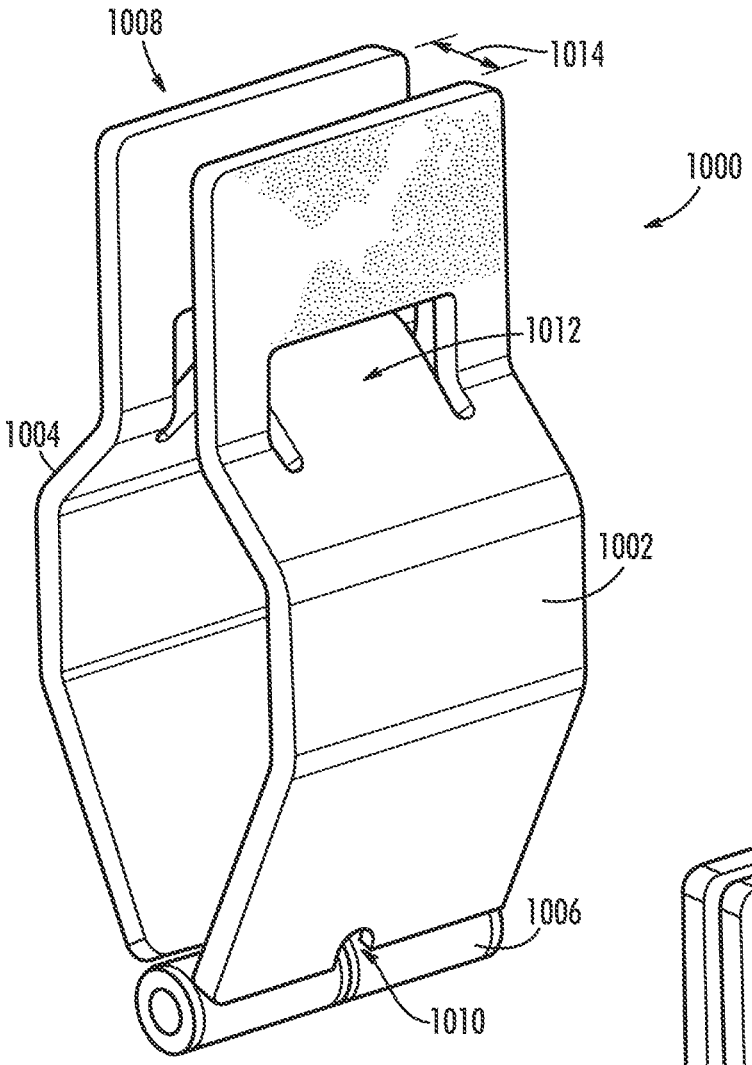
FIGS. 10 and 11 are perspective views of alternative hand grip apparatus designs, in accordance with exemplary embodiments of the invention; and, FIG. 12 is a flowchart of a method of using a hand grip exercise apparatus, in accordance with an exemplary embodiment of the invention.
Figure 11:
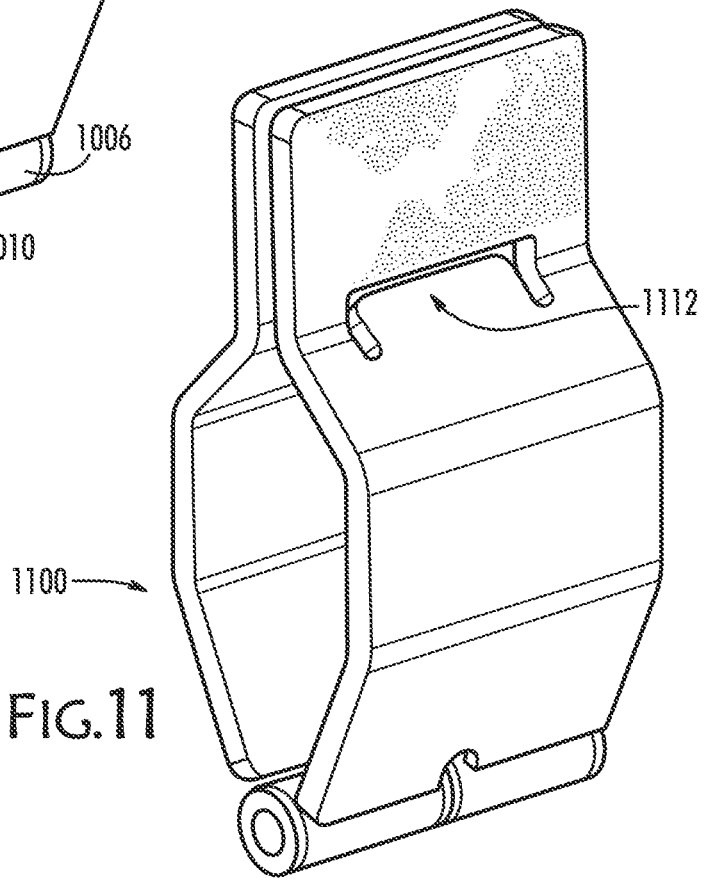
Figure 12:
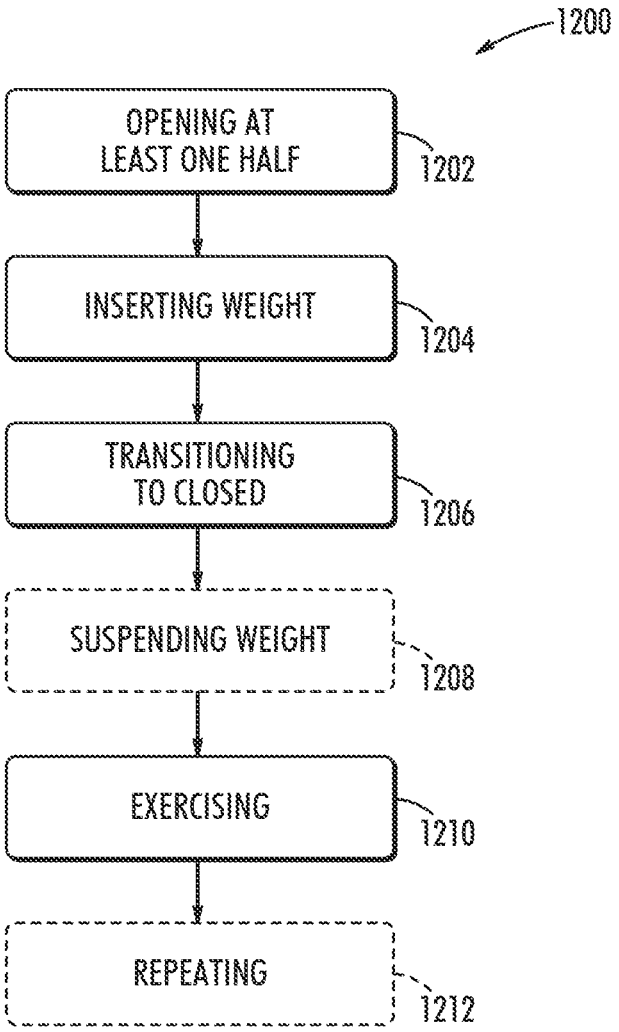

FIGS. 10 and 11 are perspective views of an alternative hand grip exercise apparatus 1000, 1100 designs, in accordance with exemplary embodiments of the invention. Hand grip exercise apparatus 1000 shows an embodiment where the user 900 would typically grip the sides of an upper portion 1008 of the apparatus 1000, instead of the sides of the halves (such as shown in FIG. 9) during exercise. In an embodiment of the invention, the upper portion 1008 is formed from an upper vertical surface, an angled portion and a tongue of each half 1002, 1004. In an embodiment of the invention, a tongue 1012 is used to provide spacing 1014 for the upper portion 1008, such that the width of the user's grip is settable by the tongue 1012.

FIG. 11 shows an embodiment of an apparatus 1100 where a shorter tongue 1112 is used to set a smaller distance between the two halves at the upper portion. It should be understood that these are by way of example only, and that different tongue lengths could be used to set different distances, and it is conceived that in some embodiments, the spacing is adjustable, for example by having an adjustable length tongue.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A hand grip exercise apparatus, comprising:

a first half configured with at least one vertical surface, at least one horizontal surface and at least one angled portion;

a second half configured with at least one vertical surface, at least one horizontal surface and at least one angled portion; and, a hinge, connecting the first half to the second half at the angled portions of each half, wherein there is texturing on at least one vertical surface of the apparatus for enhancing gripping of the apparatus.

2. The hand grip exercise apparatus according to claim 1, wherein the first half and the second half are generally L-shaped with added angled portions, where the angled portions terminate at the hinge.

3. The hand grip exercise apparatus according to claim 2, wherein for each L-shaped half the at least one horizontal surface forms the bottom of the L-shape and the at least one vertical surface forms the vertical of the L-shape.

4. The hand grip exercise apparatus according to claim 3, wherein a junction where the vertical surface and the horizontal surface meet is curved.

5. The hand grip exercise apparatus according to claim 2, wherein the first half and second half are connected together at the hinge as mirror images, such that the angled portions angle towards each other.

6. The hand grip exercise apparatus according to claim 3, wherein the horizontal surfaces of the first L-shaped half and second L-shaped half face towards each other.

7. The hand grip exercise apparatus according to claim 1, wherein the hinge is biased.

8. The hand grip exercise apparatus according to claim 7, wherein the hinge is spring-loaded.

9. The hand grip exercise apparatus according to claim 1, further comprising at least one mounting hole.

10. The hand grip exercise apparatus according to claim 1, further comprising at least one tongue for spacing the first half from the second half.

11. A hand grip exercise apparatus, comprising:

a first half configured with at least two vertical surfaces spaced apart in a vertical axis of the apparatus and at least two angled portions;

a second half configured with at least two vertical surfaces spaced apart in a second vertical axis of the apparatus and at least two angled portions; and, a hinge, connecting the first half to the second half at one of the angled portions of each half, wherein an upper portion of the hand grip exercise apparatus comprises a vertical surface and an angled portion of the first half and a vertical surface and angled portion of the second half, and wherein there is texturing on at least one vertical surface of the apparatus for enhancing gripping of the apparatus.

12. The hand group exercise apparatus according to claim 11, further comprising a tongue disposed on the angled portion of the first half of the upper portion and on the angled portion of the second half of the upper portion.

13. The hand group exercise apparatus according to claim 12, wherein the length of at least one tongue is adjustable.

14. The hand group exercise apparatus according to claim 11, wherein the hinge is biased.

15. The hand group exercise apparatus according to claim 14, wherein the hinge is spring-loaded.

16. The hand grip exercise apparatus according to claim 11, further comprising at least one mounting hole.

17. A method of using a hand grip exercise apparatus according to claim 1 or claim 11, comprising:

opening at least one of the first half or the second half of the apparatus to place the apparatus in an at least partially open configuration;

inserting a weight within the apparatus and/or suspending a weight from the apparatus;

transitioning the apparatus to a closed configuration; and, exercising using the apparatus.

* * * * *